US006575319B2

(12) United States Patent
Zumbuhl

(10) Patent No.: US 6,575,319 B2
(45) Date of Patent: Jun. 10, 2003

(54) TAB CONSTRUCTION FOR THREADED CLOSURES HAVING TAMPER-INDICATING RING

(76) Inventor: Bruno Zumbuhl, Packaging Concept Co., Inc 1801 N. Kentucky Ave., Evansville, IN (US) 47711

( * ) Notice: Subject to any disclaimer, the term of this patent is extended or adjusted under 35 U.S.C. 154(b) by 0 days.

(21) Appl. No.: 09/835,769

(22) Filed: Apr. 16, 2001

(65) Prior Publication Data

US 2001/0045406 A1 Nov. 29, 2001

Related U.S. Application Data

(60) Provisional application No. 60/199,987, filed on Apr. 27, 2000.

(51) Int. Cl.[7] ..... B65D 41/34
(52) U.S. Cl. ..... 215/252
(58) Field of Search ..... 215/252

(56) References Cited

U.S. PATENT DOCUMENTS 5,829,612 A * 11/1998 Zumbuhl ..... 215/252
5,992,661 A * 11/1999 Zumbuhl ..... 215/252
6,213,321 B1 * 4/2001 Zumbuhl ..... 215/252

* cited by examiner

*Primary Examiner*—Nathan J. Newhouse
(74) *Attorney, Agent, or Firm*—Charles E. Temko

(57) ABSTRACT

An improved threadedly engageable container closure having a frangibly interconnected tamper-indicating ring, in which the tamper-indicating ring includes a relatively thin upper portion and a relatively thicker lower portion defining a circular recess of rectangular configuration. The tabs are interconnected to an inner upper edge of the lower portion of the tamper-indicating ring by an area of cross section sufficiently thin as to impart elastic memory between the lower portion of the tamper-indicating ring and the upper portion. When the closure is installed, the tabs pivot to operative position, and remain so as the closure is installed, the relatively thinner upper portion of the ring expanding uniformly through contact of the outwardly-directed surfaces of the tab against the inner surface of the upper portion of the closure ring.

1 Claim, 4 Drawing Sheets

TAB CONSTRUCTION FOR THREADED CLOSURES HAVING TAMPER-INDICATING RING

Reference is made to my copending provisional application, now abandoned, Ser. No. 60/199,987 filed Apr. 27, 2000.

BACKGROUND OF THE INVENTION

This invention relates generally to the field of threaded closures having tamper-evident rings which separate to remain on the associated container as the cap element is manually unthreaded. and more particularly to an improved form thereof.

In my prior U.S. Pat. No. 3,829,912, there is disclosed a closure of this general type in which the tabs are of substantial cross section, whereby they are forced to function in the so-called "first mode", in which the tabs flex to only a small degree from relatively unstressed condition to engage a bead on the container neck and transmit an axially-directed force which results in rupturing of the frangible bridges which interconnect the tamper-indicating ring with the threaded cap portion of the device.

In many prior art constructions, it is known to form the tamper-indicating ring with a relatively thin upper portion which may radially expand during installation of the closure upon the container to permit the tabs to override the bead on the container, following which the tab returns to its original unstressed condition. A typical closure of this type is illustrated and described in my U.S. Pat. No. 5,992,661, granted Nov. 30, 1999. Such tabs still require substantial unthreading of the closure before they are brought into operative contact with the bead on the container neck, albeit such tabs do operate more quickly than older flexible type tabs which operate in the so-called "second model", and require inversion, so that they reduce the effective diameter of the tamper-indicating ring to less than that of the outside diameter of the bead on the container neck.

SUMMARY OF THE INVENTION

Briefly stated, the invention contemplates the provision of an improved tamper-evident closure of the class described, in which the tab configuration has been further refined to provide substantially immediate transmission of axially directed forces from the flexible tabs to the frangible bridges interconnecting the tamper-indicating ring and the threaded cap element of the closure. This is accomplished by providing pivoted tabs operating solely in the first mode, in which the tabs are initially molded to lie in a relatively radially inward position, such that when the closure is installed, the radially-extending bead on the container neck will pivot the tabs through slightly greater than ninety degrees to be wedged within an annular recess formed between the inner cylindrical surface of the upper portion of the tamper-indicating ring, and the upper surface of the thicker lower portion of the tamper-indicating ring, to remain in this position with an inner upper edge of each tab disposed closely proximate to an undersurface of the bead on the container neck, when the closure is completed seated. Thus, when an unthreading action occurs, only a nominal degree of rotation is necessary to start the bridge breaking function. During this function, substantially no further pivoting action of the tabs takes place.

BRIEF DESCRIPTION OF THE DRAWINGS

In the drawings, to which reference will be made in the specification, similar reference characters have been employed to designate corresponding parts throughout the several views.

DETAILED DESCRIPTION OF THE DISCLOSED EMBODIMENT

Figure 1:
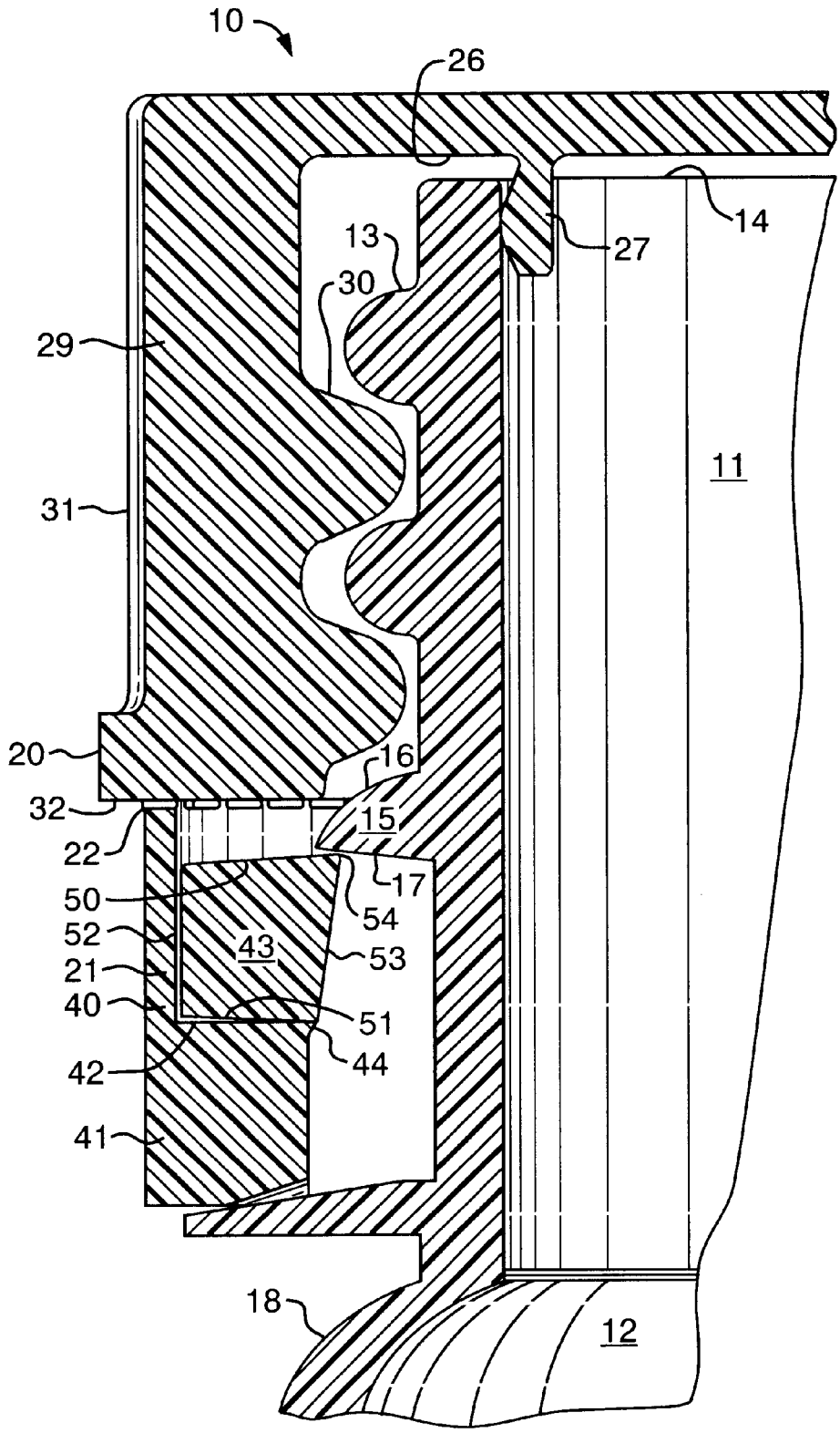
FIG. 1 is a fragmentary radial sectional view of an embodiment of the invention, showing a completely engaged closure and container neck.

In accordance with the invention, the device, generally indicated by reference character 10, is illustrated in FIG. 1 in engaged condition with the threaded neck 11 of a container 12, typically a soft drink bottle, having a continuous threaded portion 13 disposed below an upper end surface 14, and above a radially-extending bead 15 having an upper cam surface 16 and a lower radially-extending surface 17. The container may include an optional lower flange 18 to provide additional resistance to tampering, as is well known in the art.

Figure 2:
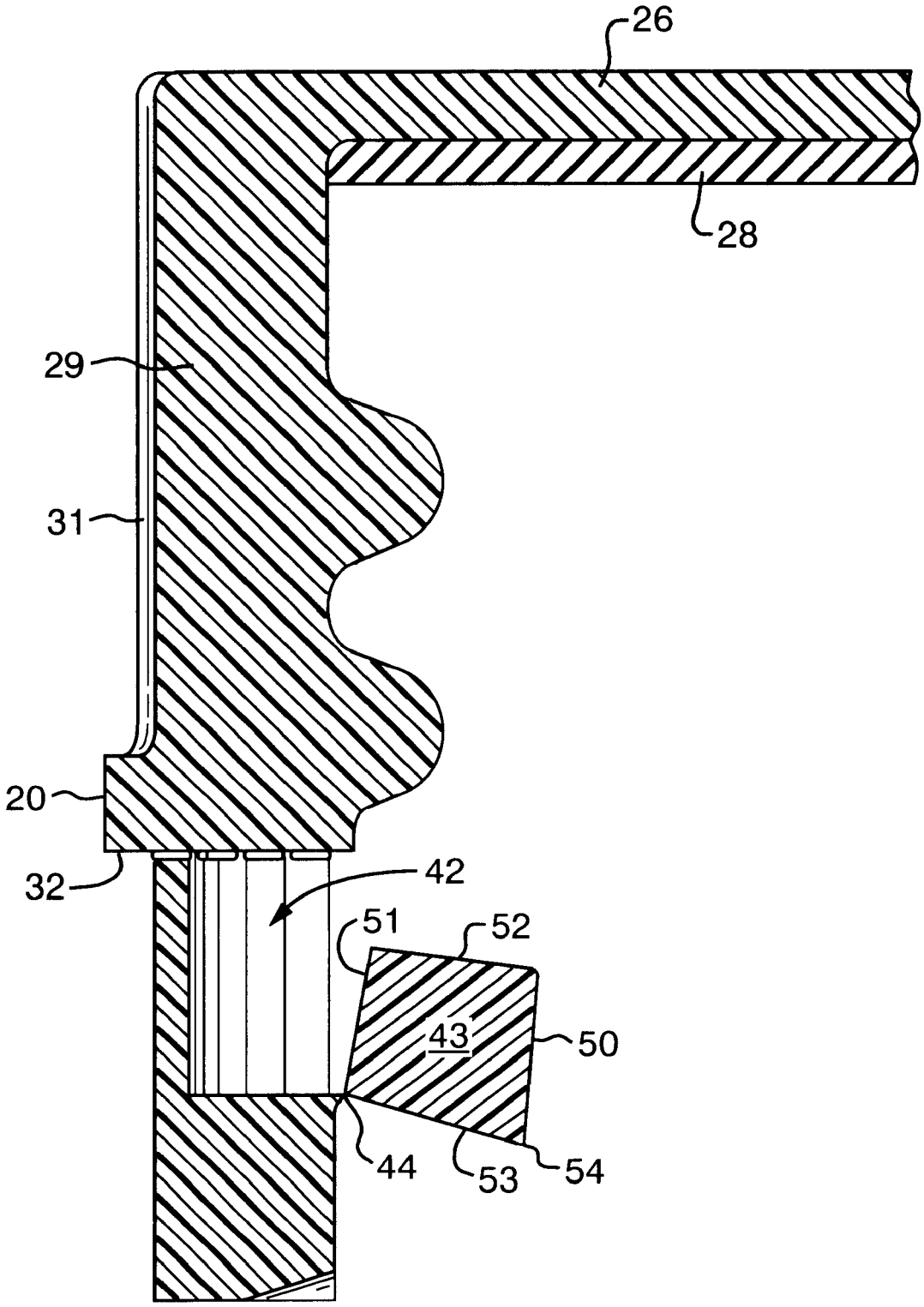
FIG. 2 is a radial sectional view showing the closure in initially molded condition.

The embodiment 10 includes a threaded cap element 20 and a tamper-indicating ring element 21 which are interconnected by a plurality of frangible bridges 22, again as known in the art. The cap element 20 includes an end wall 26 having an optional sealing ring 27, as indicated in FIG. 1, or a planar sealing gasket 28 as indicated in FIG. 2. A side wall 29 includes an internally threaded portion 30, a seated outer surface 31 as well as a lower surface 32 which interconnects with the bridges 22.

The tamper-indicating ring element 21 includes an upper thin wall portion 40 and a lower relatively thicker portion 41, the interconnection of which forms a recess 42 (FIG. 2) which accommodates plural tabs, one of which is indicated by reference character 43. The tabs are pivotally interconnected at an area of thin cross section 44 which is of such low mass as to impart substantially no elastic memory force upon the tabs 43. Thus, the tabs 43 will tend to remain in any location in which they are positioned.

The tabs 43 are substantially similar, and are of generally rectangular cross section, to include an upper surface 50, a lower surface 51, an outer surface 52, and an inner surface 54 which is disposed at an angle relative to the principal axis of the device ranging from seven to ten degrees to provide a contacting edge 54 positioned beneath the bead on the container neck.

FIG. 2 illustrates the device prior to installation, wherein the tabs, in molded condition, extend radially inwardly of the lower portion of the tamper-indicating ring.

Figure 3:
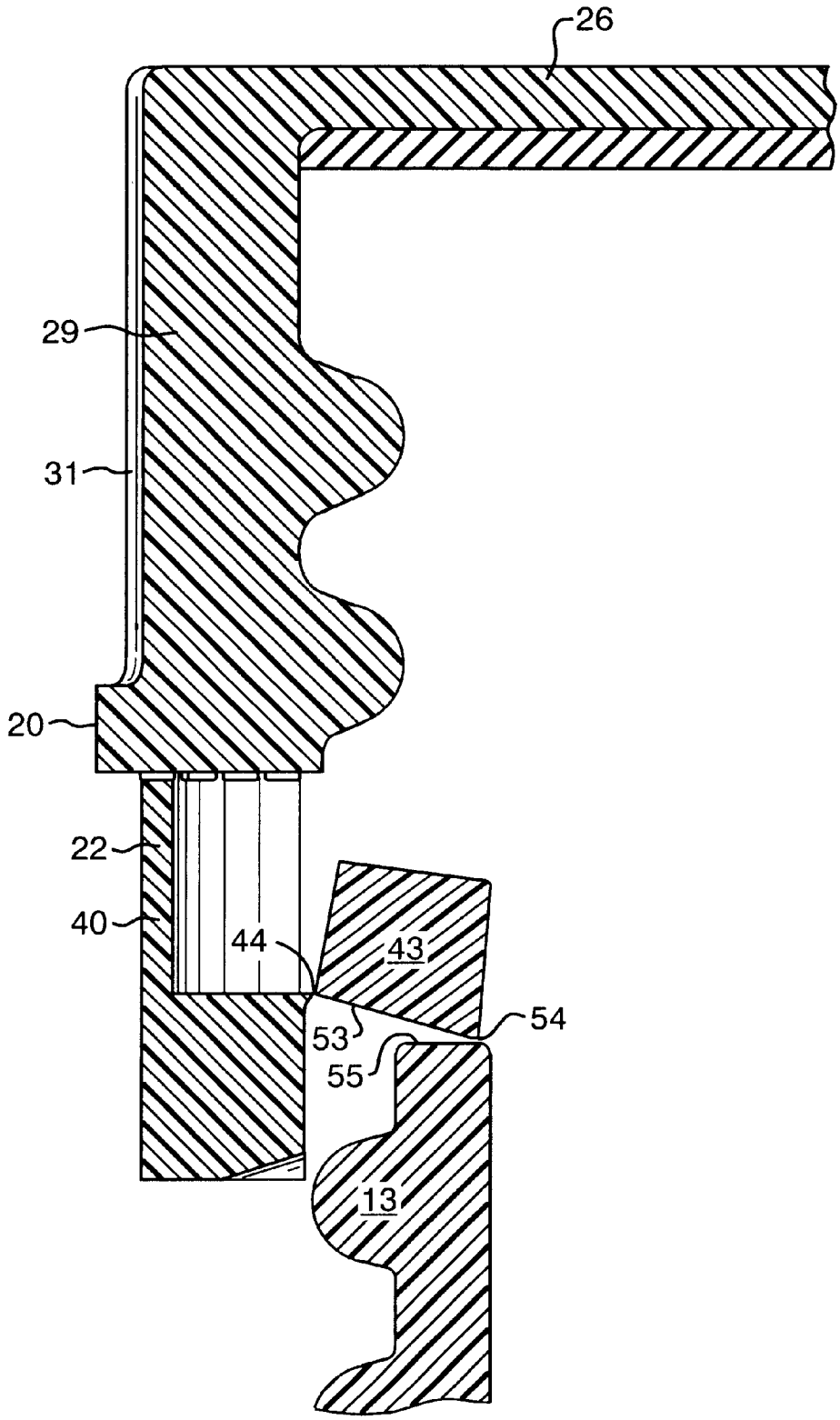
FIG. 3 is a similar sectional view showing the engagement of a tab with an upper end edge of a container neck bead prior to the initial pivoting action of the tab to the position shown in FIG. 1.
Figure 4:
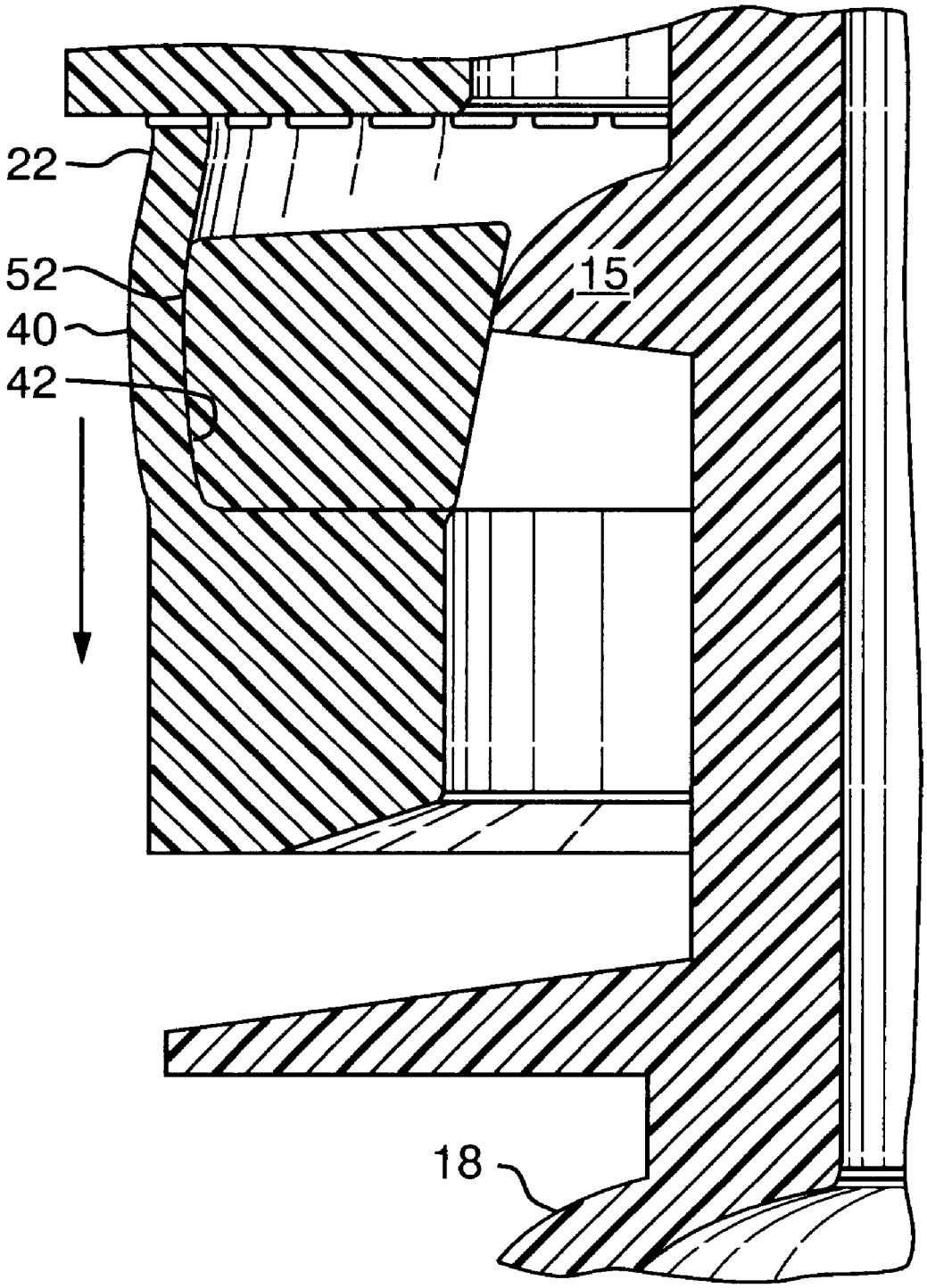
FIG. 4 is a similar sectional view showing the engagement of the tab with container neck bead causing radial expansion of the thin upper portion of the ring.

FIG. 3 illustrates the device at an initial phase of installation prior to the threaded engagement, in which the inner surface of the tabs 53 are contacted by the upper surface 47 of the container finish, so that subsequent downward relative movement results in pivoting of the tabs to the position shown in FIG. 1, which movement occurs prior to threaded engagement. It is emphasized that owing to the close fit of the tab within the recess 42, and the lack of elastic memory in the area of thin cross section 44, the tab remains in this relative position with only the inner upper edge 54 in proximate location relative to the lower surface of the bead 15. During initial installation, when the tabs clear the bead, only a small degree of radial expansion of the upper portion 40 is required, and the radial outward force is distributed over the entire contact area of the recess to facilitate flexing, since the outer surface 52 is in complete contact with the surface
47 of the upper wall portion 30. This movement will be facilitated by the fact that the closure will normally be in rotating condition as it is installed.

This, as the closure is unthreaded from the container neck, no further pivoting action of the tabs occurs, and breaking of the frangible bridges occurs almost immediately.

It may thus be seen that I have provided improved structure which permits a more rapid breaking of the interconnecting bridges between the cap element and the tamper-indicating ring element than has heretofore been possible. In addition, the tabs are more easily placed in operative position to remain so, due to the absence of elastic memory in the area of thin interconnection which interconnects the tabs with the lower portion of the tamper-indicating ring element. The proper positioning of the tab occurs as the closure is installed with a minimum of relative downward pressure being required.

I wish it to be understood that I do not consider the invention to be limited to the precise details of structure shown and set forth in the specification, for obvious modifications will occur to those skilled in the art to which the invention pertains.

I claim:

1. A tamper-indicating threaded closure for a correspondingly threaded container, said closure including a threaded cap element and a tamper-indicating ring frangibly interconnected to said cap element; said ring element including a relatively thin upper portion, and a relatively thicker lower portion defining a cylindrical recess of substantially rectangular cross section; said lower portion having an upper inwardly disposed edge defining an area of cross section sufficiently thin to produce substantially no elastic memory; a plurality of rigid tabs of generally rectangular cross section selectively engageable with a bead on said container neck corresponding to portions of said rectangular recess, and interconnected at an edge thereof to said area of thin cross section; said closure being initially molded with said tabs projecting radially inwardly to lie in the path of a surface of said container, when installed, so as to be deflected upon contact to position the tabs within said recess to remain in said position with an upper inner edge of said tabs positioned beneath said bead on said container, said upper portion of said tamper-indicating ring radially expanding over substantially its entire axial length during installation of said closure.

* * * * *